United States Patent [19]

Cournoyer et al.

[11] 3,942,639

[45] Mar. 9, 1976

[54] DISK GUARD DEVICE

[75] Inventors: Bernard T. Cournoyer, Holden; David M. Wright; Jerome M. O'Toole, both of Shrewsbury, all of Mass.

[73] Assignee: Barry Wright Corporation, Watertown, Mass.

[22] Filed: Apr. 7, 1975

[21] Appl. No.: 565,939

[52] U.S. Cl. ..... 206/444; 206/309; 211/41; 312/10

[51] Int. Cl.[2] ..... B65D 85/30

[58] Field of Search.... 206/303, 307, 309, 312–313, 206/387, 425, 444; 211/40–41, 162; 312/8–10, 13–14, 184

[56] References Cited

UNITED STATES PATENTS

| | | | |
|---|---|---|---|
| 1,190,005 | 7/1916 | Ralph | 206/309 |
| 2,807,359 | 9/1957 | McKiernan | 206/312 |
| 3,072,280 | 1/1963 | Spadaro | 312/10 X |
| 3,112,966 | 12/1963 | Reid | 206/309 X |
| 3,391,792 | 7/1968 | Makar | 211/40 |
| 3,609,722 | 9/1971 | Zenzefilis | 206/303 X |
| 3,731,794 | 5/1973 | Garrod | 206/313 |
| 3,860,248 | 1/1975 | Hunt et al. | 206/309 X |

FOREIGN PATENTS OR APPLICATIONS

| | | | |
|---|---|---|---|
| 1,116,701 | 6/1968 | United Kingdom | 206/309 |

*Primary Examiner*—William Price
*Assistant Examiner*—Steven E. Lipman
*Attorney, Agent, or Firm*—Milton E. Gilbert

[57] ABSTRACT

Guard device for storing a disk package comprising a jacket containing a flexible magnetic disk, said device being substantially rigid and having a front or cover surface, a back surface, sides and a bottom, said cover surface being preferably shorter in length than the back surface to permit a label on the jacket to be observed as well as to permit writing on the label and the sides preferably extending above the cover to protect the side edges of the disk package. The device also preferably includes ribs to protect a pocket for the disk package as well as restraining ribs located at the bottom of the pocket.

17 Claims, 11 Drawing Figures

DISK GUARD DEVICE

BACKGROUND OF THE DISCLOSURE

This invention is directed to a protective guard device to store flexible magnetic disks of the type which are used for storing data e.g., digital data. Conventional flexible magnetic disks are of thin, flexible, magnetizable material and are generally cylindrically shaped. The disks are conventionally packaged in a partially cutaway jacket generally of flexible plastic and which exposes a portion of the disk. The jacket is sealed along its edges to hold the disk therein.

For purposes of this disclosure a combination of the disk and jacket is hereinafter referred to as a disk package.

Heavy paper envelopes are now conventionally used to store the disk package. The paper envelope is used to protect the disk package during storage and handling of same. While the envelope does provide protection, the abuse given to the envelope during continual handling, and accidental dropping generally causes wear at the edges of the envelope and thus the envelope will often split and expose the enclosed disk package.

Exposure of the disk package may permit scratching of the disk which may then be a cause of loss of data on the magnetic storage media of the disk. In addition, paper envelopes are subject to bending and are easily puncturable when moved about while being stored in a conventional filing system.

Bending of the disk for a prolonged period of time can cause a permanent formed set to the disk which may result in loss of stored date. Paper envelopes also tend to absorb liquids which then have a tendency to cause damage to the disk held therein.

In view of the above, a new and improved storage system was needed to replace the conventional paper envelopes, folders or the like used today to store magnetic disks.

The present invention overcomes the above mentioned disadvantages by providing a substantially rigid guard storage device preferably of plastic that will not easily wear, will not easily absorb liquid and will prevent bending or twisting of the disk during storage.

The device of this invention also permits easy access to and handling of the disk as well as being particularly adapted for storage in filing systems.

BRIEF SUMMARY OF THE DISCLOSURE

This invention is directed to a substantially rigid disk guard device particularly suited for storing therein a flexible magnetic disk package of the type used to store digital data.

The guard device is substantially rigid and is preferably of plastic. The device has a front cover, back surface, sides and a bottom. The front cover is preferably shorter than the back surface to expose a portion of the disk unit and the sides preferably extend above the front cover to protect the side edges of the magnetic disk package.

The guard device preferably has means at the bottom to hold the jacket of the disk package in the interior thereof without bearing on the disk held within the jacket, so as not to injure same.

Other features preferably include reinforcing ribs which provide a pocket for the disk package as well as hooks to permit storage of the guard device on rails or the like. In addition, projections at the bottom of the device are also preferably provided to facilitate pivoting or fanfolding thereof when stored in a cabinet drawer.

DETAILED DESCRIPTION OF THE DISCLOSURE

Figure 8:
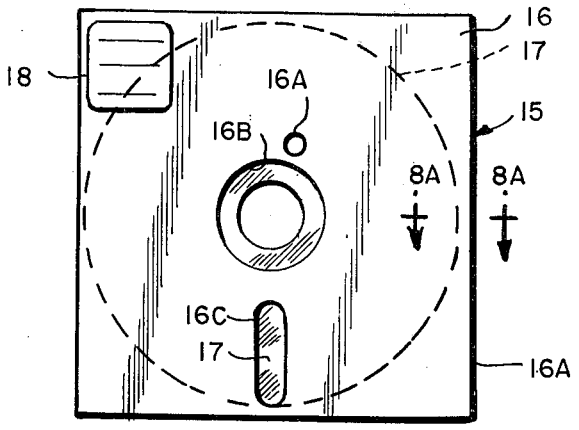
FIG. 8 is a plan view of the disk package.
Figure 9:
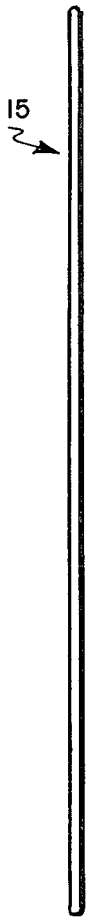
FIG. 9 is a side view of the disk package.
Figure 8A:
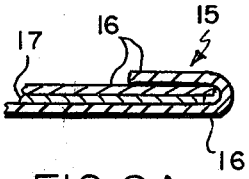
FIG. 8A is a partial sectional view taken along line 8A—8A of FIG. 8.

At this time reference should briefly be had to FIGS. 8, 8A and 9 for an understanding of the conventional magnetic disk package or diskette used in computer systems to store data.

The disk package is shown at 15 and generally includes a rectangular outer flexible jacket 16 e.g., nylon having openings 16A, 16B and 16C extending therethrough and exposing portions of a flexible magnetic material disk 17, e.g., cylindrically shaped and appearing round. The jacket covers the top, bottom, and sides of the disk except where there are openings. One side of the jacket overlaps the other side (see FIG. 8A).

Figure 7:
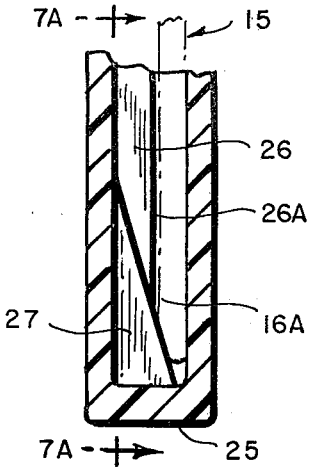
FIG. 7 is a sectional view taken along line 7—7 of FIG. 1 illustrating the disk package held in the guard device.
Figure 7A:
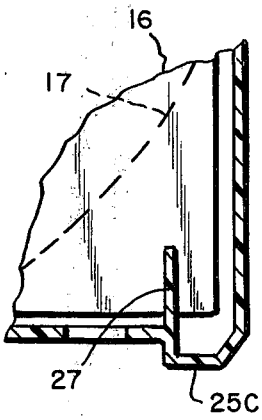
FIG. 7A is a partial sectional view illustrating the disk package stored in the guard device taken along line 7A—7A of FIG. 7.

As may be observed the magnetic disk 17 is spaced away from the corners of the jacket (see FIG. 7A). The jacket is also usually provided with a label 18 upon which identification information may be written by the user.

The disk package i.e., jacket and disk are generally of very flexible material and thus both are subject to bending in use.

Reference should now be had to FIGS. 1–7A which illustrate the disk guard device 20 of this invention. The guard device comprises a cover or front surface 21, back surface 22, sides 23 and bottom 25. The back surface 22 is preferably smooth and flat. The cover surface preferably has a plurality of reinforcement ribs 26 which add strength and help provide a pocket area 20A between the rib surface 26A and the back surface 22 for the placement of disk package 15.

The side surfaces 23 are preferably extended at 23A above the front cover surface 21 to protect the edges of the disk package 15 that protrudes above the front cover surface 21. The cover surface 21 is preferably shorter in length than the back surface 22 to permit the label 18 to be visible and be open for writing information on the label.

The bottom 25 may be provided with holes 25A if desired. A further most preferred feature of this invention is the plurality of restraining ribs 27 positioned at the bottom of the pocket. The ribs 27 may be supported by the front cover 21 as shown and preferably extend only a small distance along the cover 21 interior. The ribs 27 are preferably inclined as shown in FIG. 7 and extend outwardly from the cover 21 a distance greater than the ribs 26.

The inclined ribs 27 preferably are of a dimension to cause squeezing of one jacket surface towards the opposite jacket surface thereby holding the disk package firmly in the pocket against the back surfaces 22 (see FIG. 7). The restraining ribs 27 are preferably spaced a distance apart so that they do not force or squeeze together the jacket portion which overlies the disk 17 (see FIG. 7A), and thus are not a source of damage to the disk surface.

In order to permit the disk guard device 20 to be easily stored in a cabinet having supporting bars or rods 30, there is provided hooks 24 with reinforcements above and below.

Figure 2:
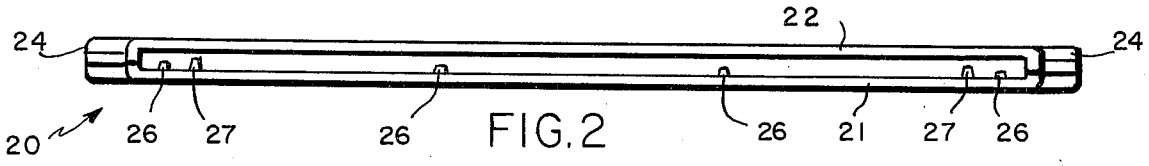
FIG. 2 is a top plan view of the guard device.
Figure 3:
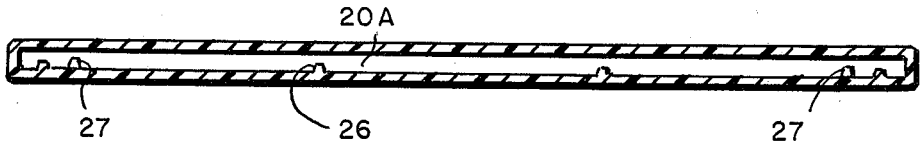
FIG. 3 is a sectional view taken along line 3—3 of FIG. 1.
Figure 1:
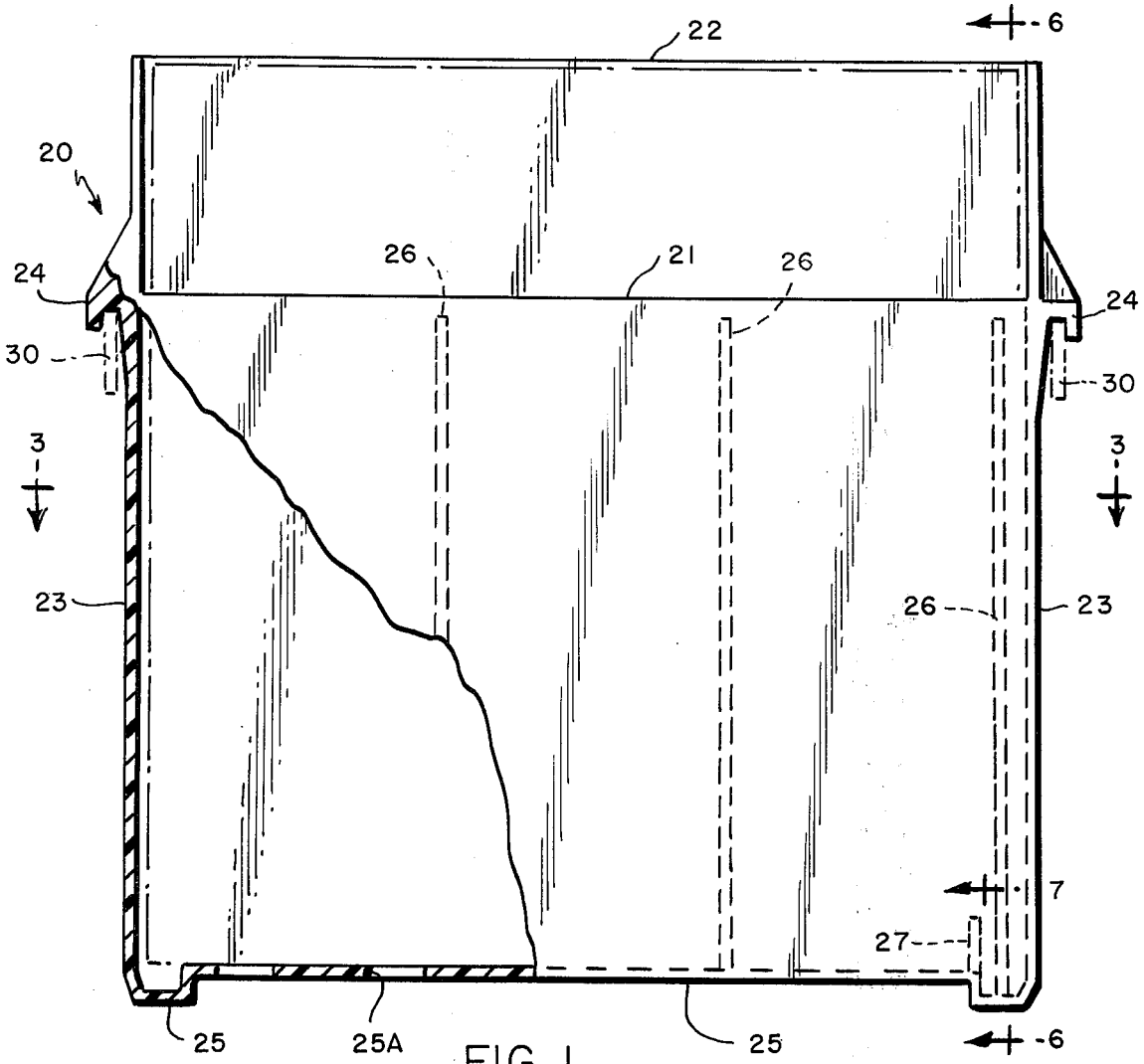
FIG. 1 is a front plan view with parts broken away of the guard device of this invention.
Figure 4:
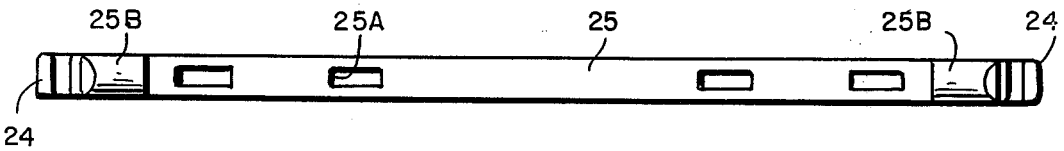
FIG. 4 is a bottom plan view of the guard device.
Figure 5:
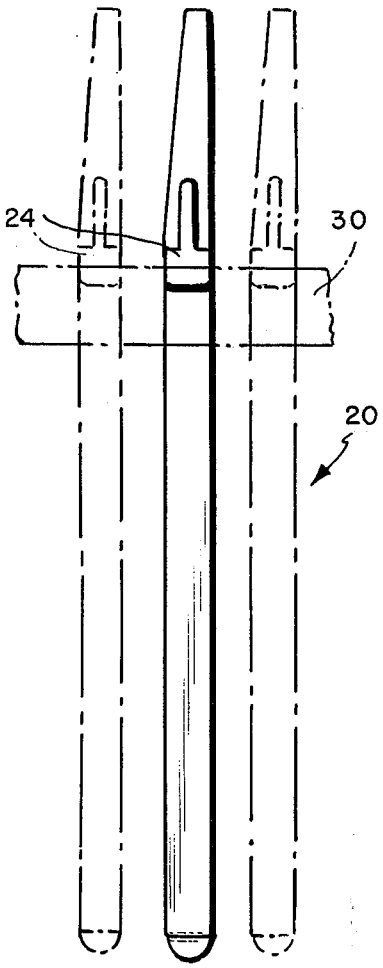
FIG. 5 is a side view illustrating a plurality of guard devices supported on a bar of a storage unit.
Figure 6:
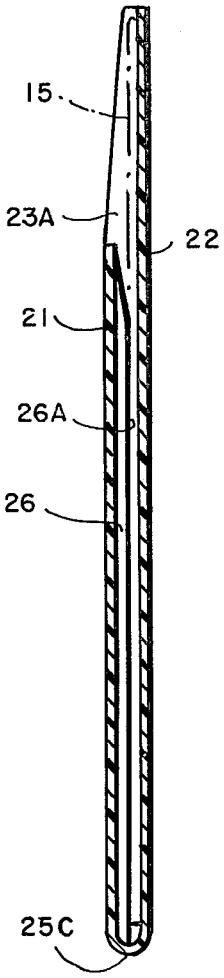
FIG. 6 is a sectional view taken along line 6—6 of FIG. 1.

The hooks are positionable as shown in FIGS. 1 and 5 to permit a plurality of disk guard devices to be slideably hung in a drawer on bars 30.

A further preferred feature of this invention includes bottom extensions 25B preferably rounded with full radius 25C to permit the guard device to pivot or fanfold when the device is stored in a drawer. The guard device 20 of this invention may be fabricated using conventional injection molding techniques.

The device is preferably constructed of a durable plastic which is substantially rigid such as provided by well known grades of polyvinylchloride (PVC), polyethylene, polypropylene, polystyrene, etc., which have substantially rigid properties. The plastic material should provide sufficient rigidity to prevent bending of the disk.

It should be understood that the guard device 20 may if desired be constructed of other substantially rigid material other than plastic e.g., plexiglass, as long as protection is provided to the disk, although plastics are preferred because they are readily molded using conventional techniques.

We claim:

1. A guard device for the storage of a flexible magnetic disk package which comprises a flexible jacket in which there is positioned a flexible magnetic disk, said device being substantially rigid and comprising a cover surface, back surface, sides and a bottom, a plurality of pocket defining ribs supported by one of said surfaces and extending inwardly towards the other of said surfaces to provide a pocket for said disk package, and restraining means positioned adjacent the bottom and supported by one of said surfaces to urge the jacket of said package towards the other of said surfaces, said restraining means engaging said jacket at a point under which the disk does not lie.

2. The device of claim 1 in which the device is constructed of plastic.

3. The device of claim 1, said restraining means comprising at least two inclined ribs spaced apart and located near the sides.

4. The device of claim 3 in which said restraining ribs extend from the cover surface towards said back surface.

5. The device of claim 4 in which said pocket defining ribs extend from the cover surface towards said back surface.

6. The device of claim 5 in which said pocket defining ribs extend towards said back surface a distance less than said restraining ribs.

7. The device of claim 6 in which said cover surface is shorter in length than said back surface and in which said sides extend above said cover surface.

8. The device of claim 7 in which each of said sides are provided with hook means.

9. The device of claim 7 in which said bottom has rounded extensions to facilitate pivoting of said device.

10. In a guard device for the storage of a flexible magnetic disk package which comprises a flexible magnetic disk supported within a flexible jacket, the device comprising a front cover, a back surface, sides, and a bottom, said cover being shorter in length so that the jacket is partially exposed to view when supported in the device, said sides extending above the cover to protect the sides of the package, said device being of substantially rigid material to prevent bending of the disk while stored in the device.

11. In the device of claim 10, a plurality of pocket defining ribs extending from one of said surfaces to define a storage pocket between the ribs and the other of said surfaces.

12. In the device of claim 11 in which there is provided a plurality of restraining ribs adjacent said bottom and supported by one of said surfaces to urge said disk package against the other of said surfaces.

13. In the device of claim 12 in which said restraining ribs and said pocket defining ribs extend from the interior of said cover surface towards said back surface, said restraining ribs extending further towards said back surface then said pocket defining ribs.

14. In the device of claim 13 in which hooks are supported by said sides.

15. In the device of claim 13 in which the bottom includes curved projections extending therefrom to facilitate pivoting of the device.

16. In the device of claim 13 in which said ribs are spaced apart a distance such that when the disk package is positioned in the pocket, only the jacket portion is urged inwardly where it does not overlie the disk.

17. In the device of claim 16 in which said restraining ribs include inclined portions.

* * * * *

UNITED STATES PATENT AND TRADEMARK OFFICE

CERTIFICATE OF CORRECTION

PATENT NO. : 3,942,639

DATED : March 9, 1976

INVENTOR(S) : Bernard T. Cournoyer, David M. Wright, and Jerome M. O'Toole

It is certified that error appears in the above-identified patent and that said Letters Patent are hereby corrected as shown below:

Column 1 - Line 33: Delete word "date" and substitute therefor the word "data"

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*